US011174652B1

(12) United States Patent
Gross et al.

(10) Patent No.: US 11,174,652 B1
(45) Date of Patent: Nov. 16, 2021

(54) BI-DIRECTIONAL LEAF RAKE

(71) Applicant: Purity Pool, Inc., Redding, CA (US)

(72) Inventors: Richard S. Gross, Redding, CA (US); Richard R. Gross, Phoenix, OR (US)

(73) Assignee: Purity Pool, Inc., Redding, CA (US)

( * ) Notice: Subject to any disclaimer, the term of this patent is extended or adjusted under 35 U.S.C. 154(b) by 0 days.

(21) Appl. No.: 16/786,690

(22) Filed: Feb. 10, 2020

Related U.S. Application Data

(60) Provisional application No. 62/804,343, filed on Feb. 12, 2019.

(51) Int. Cl.
*E04H 4/16* (2006.01)

(52) U.S. Cl.
CPC ..... *E04H 4/1609* (2013.01)

(58) Field of Classification Search
CPC ..... E04H 4/1609
USPC ..... 210/167.1, 238, 470, 471
See application file for complete search history.

(56) References Cited

U.S. PATENT DOCUMENTS 4,169,331 A * 10/1979 Baker ..... A01K 77/00 15/1.7
5,223,135 A * 6/1993 MacPhee ..... B01D 33/0175 15/1.7
5,473,786 A * 12/1995 Resh ..... B01D 29/27 15/1.7
6,358,410 B1 * 3/2002 Lambert ..... E04H 4/1263 210/232
7,033,490 B2 4/2006 Blackman et al.
2006/0016047 A1 * 1/2006 Blackman ..... B25G 1/06 16/231

* cited by examiner

*Primary Examiner* — Fred Prince
(74) *Attorney, Agent, or Firm* — Heisler & Associates

(57) ABSTRACT

Leaves and other debris within water are collected into a porous basket by passing a hoop surrounding an opening of the basket through the water, typically while mounted to a tip of a pole. An interface (such as an elbow) and an attachment couple the hoop of the basket to the tip of the pole. The interface and attachment are pivotally attached together. The interface has a leading portion opposite of trailing portion, with the trailing portion coupled to the hoop and the leading portion forward of a hoop plane. The attachment pivotally attaches to the leading portion of the interface. The attachment and pole can pivot through a wide range of angles relative to the interface and the hoop, and facilitate collection of leaves both when the basket is being maneuvered away from a user and toward a user, and without requiring any rotation of the pole.

16 Claims, 3 Drawing Sheets

BI-DIRECTIONAL LEAF RAKE

CROSS-REFERENCE TO RELATED APPLICATIONS

This application claims benefit under Title 35, United States Code § 119(e) of U.S. Provisional Application No. 62/804,343 filed on Feb. 12, 2019.

FIELD OF THE INVENTION

The following invention relates to leaf and debris collection baskets for collecting debris from bodies of water, such as swimming pools and ponds. More particularly, this invention relates to leaf and debris removal baskets which can collect debris both when moving away from the user and toward the user.

BACKGROUND OF THE INVENTION

Keeping leaves and other debris out of a swimming pool or other similar body of water is an ongoing chore. While various different automated equipment and methods are known in the prior art for at least partially addressing this issue, significant utility is still provided by merely having a leaf basket coupled to a hoop and connected to a long pole, used to collect debris from the pool. One aspect of the usefulness of such a tool is that it is effective both when used along a surface of the pool, as well as along a bottom of a pool and at mid-depths.

One drawback of many such manual pole based pool cleaning baskets is that they can be difficult to use when moving directly toward and away from the user, and when the basket is a long distance away from the user. This is because as the basket is further and further away from the user, the basket opening will necessarily be facing more and more upwardly or downwardly, and further from perpendicular to the surface of the water and perpendicular to the direction that the basket is moving. While the hoop from which the basket is suspended could be angled relative to the pool, such an angle might only be effective when the basket is a certain distance away from the user and when moving in one direction, but then would be particularly disadvantageously oriented when otherwise utilized. Fatigue and joint pain (and even potential joint damage over time from continually twisting the pole to reverse direction) can result from attempts to maneuver prior art leaf baskets.

One prior attempt to solve this problem and to provide a manual pole-based basket is disclosed in U.S. Pat. No. 7,033,490. While this tool maintains a high quality angle at the opening, generally oriented within a plane perpendicular to the surface, both when being pushed away from user and pulled toward the user, this prior art device is configured for use on the surface exclusively. Also, significant complexity is involved, including an elongate swivel bar which partially blocks an opening through the hoop and into the basket. This extra equipment adds weight, which can be very difficult to manage at the end of the pole, but which is not a problem of particular concern when the device also includes floats and is only used on the surface. However, a need exists for such a pole mounted basket which can be used both when moving toward and away from the user and which can be used at the bottom of the pool or at mid-depths. Such a tool would beneficially minimize additional equipment to minimize weight at the end of the pole, for maximum ease in handling, especially when the basket is far away from the user.

SUMMARY OF THE INVENTION

With this invention, a bi-directional leaf rake is provided which generally includes a basket suspended from a hoop, and with a method/apparatus on the hoop for connection to an elongated pole. The pole is held by the user and the hoop is maneuvered to cause leaves and other debris to pass through the opening within the hoop and into the basket. Uniquely, this invention includes a very simple mechanism to facilitate pivoting between the pool and the hoop. This allows for bi-directional operation, while maintaining neutral (or slightly negative) buoyancy for use at the bottom of the pool and at mid-depths, as well as at the surface, and yet keeping the basket end of the device light enough for easy use when the basket is far from the user.

An attachment arm is pivoted to the hoop, preferably along one of two long segments of the hoop which are joined together by short curving opposite lateral ends of the hoop. The attachment arm is typically configured so that it can be removably attached at a tip of the pole, or the arm could conceivably be permanently attached to the pole or formed along with the pole if desired. A distal end of the attachment arm is pivotally attached to an elbow or other form of interface which is in turn coupled to the hoop, typically at the midpoint of one of the long segments of the hoop. This elbow can be a 90° elbow or a 45° elbow or some other angular spacing of elbow.

The elbow causes a leading end thereof, which is coupled to the distal end of the attachment arm, to be elevated forward of the point of entry of leaves and/or debris through the hoop and into the basket. This elbow positioning facilitates pivoting the arm relative to the hoop all the way up to a plane in which the hoop is oriented, and even past this plane, perhaps up to 30° or 45°. Thus, a user can move the tool in various different directions and the hoop remains oriented in an "open" configuration moving through the water and with the basket trailing behind, for collection of leaves and other debris, either when moving away from the user or toward the user. This is because the elbow or other attachment to the hoop is pivotally attached to the distal end of the attachment arm or otherwise to the pole, to allow drag associated with the basket passing through the water to cause the basket to trail behind the hoop at all times, and causing the elbow to be oriented ahead of the basket and with the basket "open," that is with the hoop oriented within a plane which is perpendicular to the direction of motion of the hoop through the water.

The hoop has a rigid form, which can be provided by a metal spine to which the elbow is connected, most preferably in a fixed manner. The hoop could have other interior (or exterior) structural materials, including plastic materials. Preferably an outer jacket or cover of the hoop has a thin edge to allow for scraping a bottom of the pool, such as to collect a leaf which is firmly against a bottom (or side) of the pool, for collection into the basket. This simple configuration optimally consists only of the basket, the hoop, the elbow (or other interface) and the attachment arm. A user could conceivably hold the attachment arm and use the tool as a hand tool, and without the pole. Most preferably, a pole is attached to the attachment arm to allow the tool to be used at a greater distance away from the user. Many such poles are of telescoping form and have a basic length (e.g. 8 feet), which can be increased by telescoping movement of two nested polls associated therewith (such as to approximately 16 feet).

The pivot joint between the elbow and the distal end of the attachment arm can be provided by passing a pivot pin through ears which are parallel to each other at the distal end of the attachment arm, and spaced apart by a gap width similar to a width of the elbow. The elbow has a hole passing through the leading end thereof, adjacent to the distal end of the attachment arm, with a pin passing through this hole in the elbow, as well as through holes in the ears of the distal end of the attachment arm. The pivot pin holds the elbow and distal end of the attachment arm together, to facilitate rotation about this pin. Other types of pivot joints could alternatively be utilized. While the elbow is preferably spaced from the distal end of the attachment arm, forward of the opening into the hoop, it is conceivable that other positions for this pivot joint could be provided by providing extensions of other shapes extending from an attachment point on the hoop to a pivot point selected to be at some other location.

Removable attachment of the attachment arm to a pole can occur through holes at the proximal end of the attachment arm which can receive a pin of some sort, either provided on the proximal end of the attachment arm, provided on a tip of the pole, or separately provided, which would pass through holes in the pole as well as through the holes in the proximal end of the attachment arm. Pole elements preferably have a cylindrical form so that the proximal end of the attachment arm (which is also cylindrical) and the pole, are sized to nest together in a manner allowing translation but not pivoting or other rotation therebetween (other than about a long axis of the pole), and which movement is restricted by the existence of the pin to hold the two parts together. Other forms of attachment could be provided for the proximal end of the attachment arm, or the attachment arm could be used without the pole, or formed with the pole as a single unit.

In use, typically a user will stand close to an edge of the pool adjacent to an area to be cleaned. The user usually puts the basket in the pool at a location closest to the user (or closer to the debris to be collected). The basket is then navigated straight away from the user, either at the water surface or more deeply if submerged debris is to be collected. As the basket is pushed away from the user, the hoop is pivoted open and the basket/mesh trails behind the hoop, with enough drag to keep the hoop facing forwardly and open. When the far side of the pool is reached, or other desired stopping distance is reached, the user switches from pushing to pulling on the pole. The hoop then flips and the basket trails behind, while the basket applies a drag force on the hoop, keeping the hoop open and the basket trailing behind the hoop. Depth of the hoop can be controlled to encounter debris to be collected. When a user desires to move laterally, typically small lateral movements can be added to the major pushing and pulling action to allow the hoop and basket to cover other portions of the pool. In this way, the basket and hoop can be placed where desired without requiring major lateral movements of the pole when the basket is far from the user and hard to handle.

Configurations for the hoop and basket can vary in the manner known in the pool cleaning arts, such as by increasing the size of the basket or decreasing the size of the basket, and providing different shapes and sizes for the hoop, such as to decrease drag when moving through the water, or to facilitate collecting debris against surfaces of the pool, such as the floor of the pool and side surfaces of the pool. The entire basket assembly including the hoop preferably is neutrally or slightly negatively buoyant. Such neutral or slightly negative buoyancy is provided by not including any form of float, and generally including the structure which avoids collection of air bubbles in any portions thereof. Also, the elbow and attachment arm preferably also are configured to avoid collection of air in them. As an alternative, the attachment arm and elbow could be slightly greater in density than water and the hoop and/or basket could be slightly less in density than water, so that an average density of the attachment arm, elbow, hoop and basket will be similar to an average density of water, and overall neutral or slightly negative buoyancy would still be achieved.

In one embodiment, the basket and hoop could have a very slight positive buoyancy, such as for instance to cause the device to float when it is dropped into the pool, and to make it easier to recover. Also, with such a slight positive buoyancy, the tool could be used upon an upper surface of the water within the pool somewhat more easily without it wanting to dive under the surface, but would be sufficiently close to neutrally buoyant that only small additional forces would be required by a user to cause the hoop and basket to dive under the surface of the water and down to a bottom or middle depths of the pool.

OBJECTS OF THE INVENTION

Accordingly, a primary object of the present invention is to provide a leaf rake or other leaf and/or debris collection basket which can collect leaves and/or other debris both when moving away from a user and toward a user.

Another object of the present invention is to provide a leaf rake which has a pivotal attachment relative to a pole or other handle to allow for proper orientation of a hoop of the basket both when moving toward a user and away from the user.

Another object of the present invention is to provide a leaf rake which can be used when moving toward a user and when used moving away from a user, and without requiring rotation of the pole or other handle by the user.

Another object of the present invention is to provide a leaf rake which is neutral or slightly negatively buoyant for ease in maneuvering at different elevations of a body of water.

Another object of the present invention is to provide a leaf rake which automatically maintains an effective hoop orientation when moving toward or away from a user.

Another object of the present invention is to simplify the process of cleaning leaves and other debris from a swimming pool or other body of water.

Another object of the present invention is to provide a method for removal of leaves and other debris from a pool which method is easy to perform and requires only limited strength.

Another object to the present invention is to provide a leaf and other debris removal tool which can be used at various different elevations within the water when both moving toward a user and away from a user, or otherwise in a first direction opposite a second direction, and without requiring rotation of the handle or pole supporting the leaf and/or debris collection basket.

Other further objects of the present invention will become apparent from a careful reading of the included drawing figures, the claims and detailed description of the invention.

DESCRIPTION OF THE PREFERRED EMBODIMENT

Figure 1:
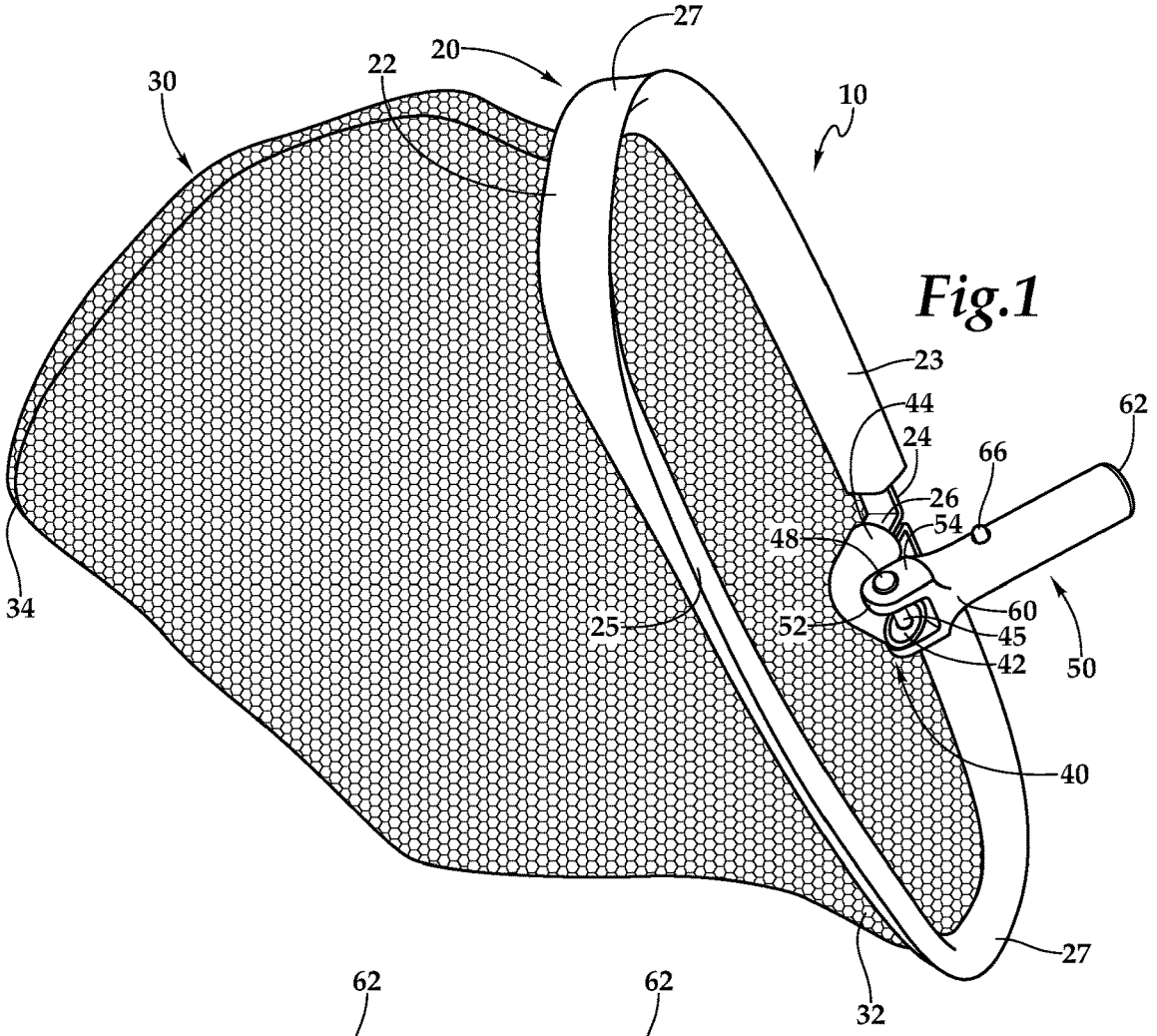
FIG. 1 is a perspective view of the leaf rake according to one embodiment of this invention.
Figure 2:
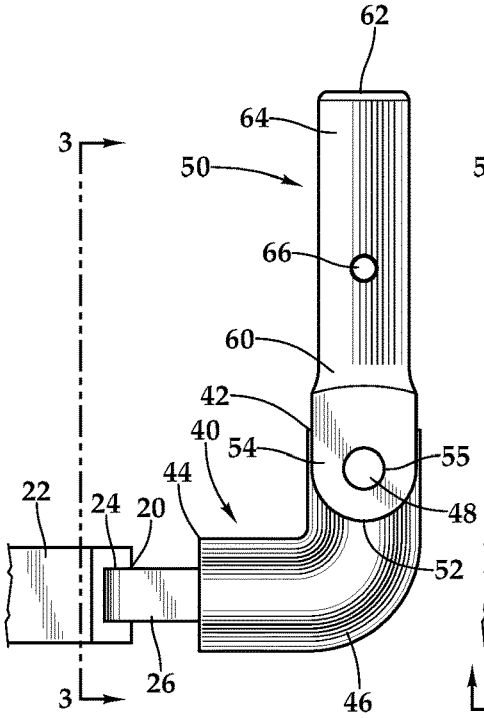
FIG. 2 is a side elevation view of an interface and attachment interposed between a hoop of a basket and a tip of a pole, and which interface and attachment facilitate operation for collection of leaves and debris from a body of water when moving in both a forward direction away from a user and a rearward direction toward a user.
Figure 3:
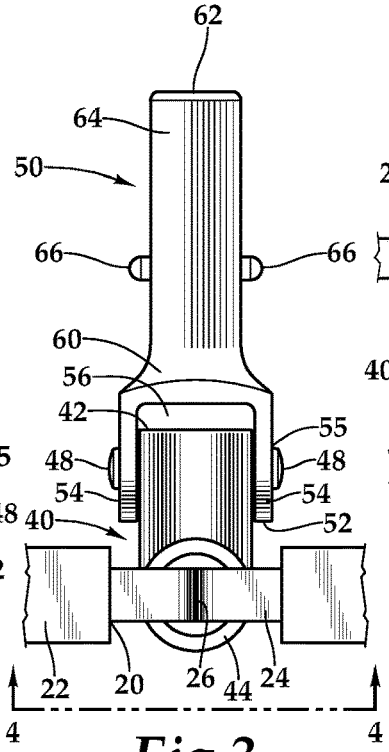
FIG. 3 is a rear elevation view of that which is shown in FIG. 2 and from a perspective illustrated by line 3-3 of FIG. 2.
Figure 4:
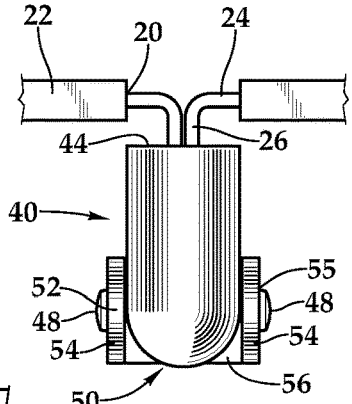
FIG. 4 is a front elevation view of that which is shown in FIG. 2 and from a perspective illustrated by line 4-4 of FIG. 3.

Referring to the drawings, wherein like reference numerals represent like parts throughout the various drawing figures, reference numeral 10 is directed to a leaf rake (FIGS. 1, 5 and 6) which features pivotal attachment between an attachment arm 50 couple able to a pole 60 and an elbow 40 or other interface coupled to the basket 30 through a hoop 20. With such pivotal attachment (along arrow C of FIGS. 5 and 6) the leaf rake 10 can function both when moving in a forward direction (arrow A of FIG. 5) and in a rearward direction (arrow B of FIG. 6) without requiring rotation of the pole 70 or other handle.

Figure 5:
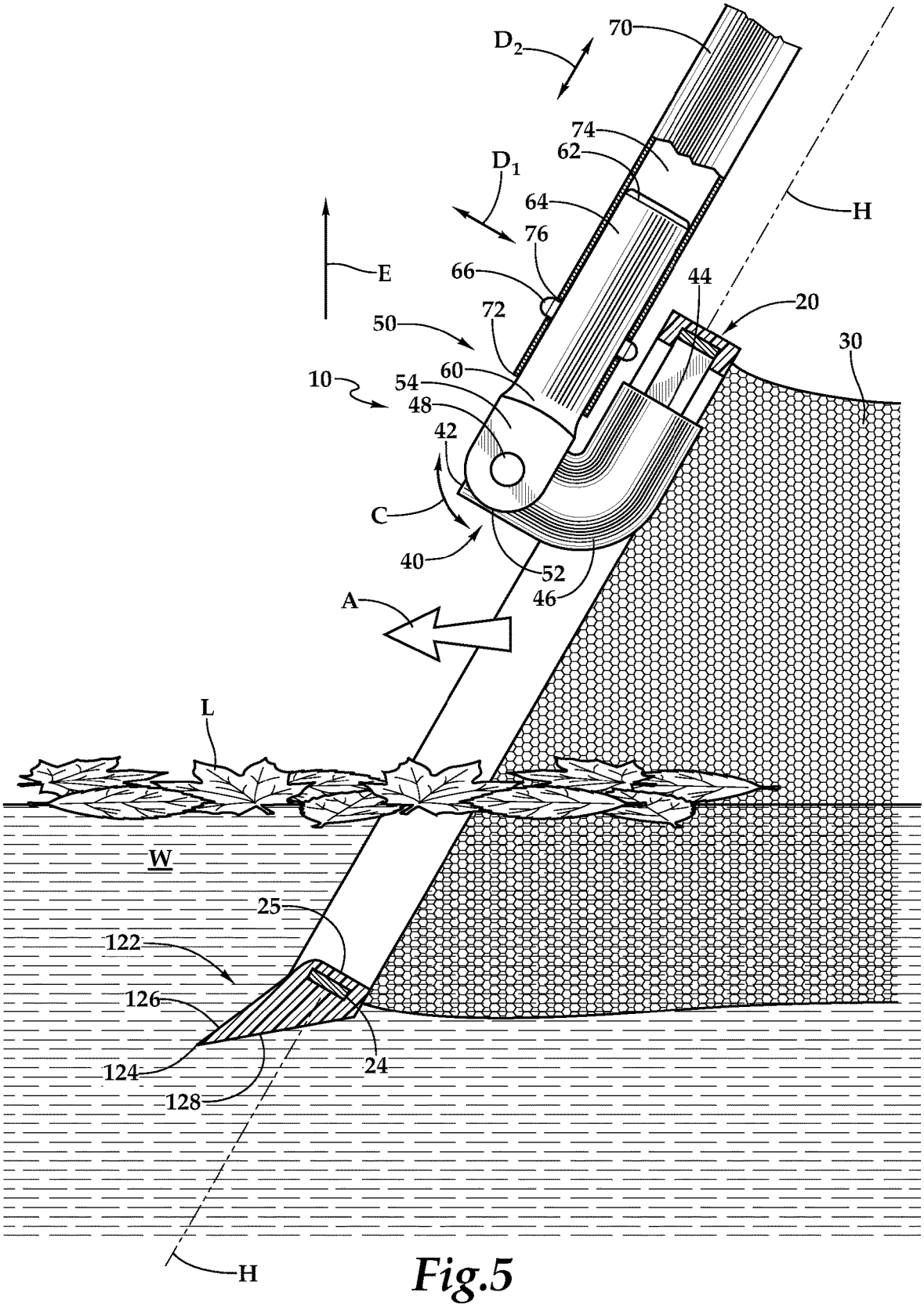
FIG. 5 is a side elevation view of the leaf rake shown in the embodiment of FIG. 1, with a hoop and basket located within a body of water and collecting leaves while attached to a pole and moving in a forward direction away from the user.
Figure 6:
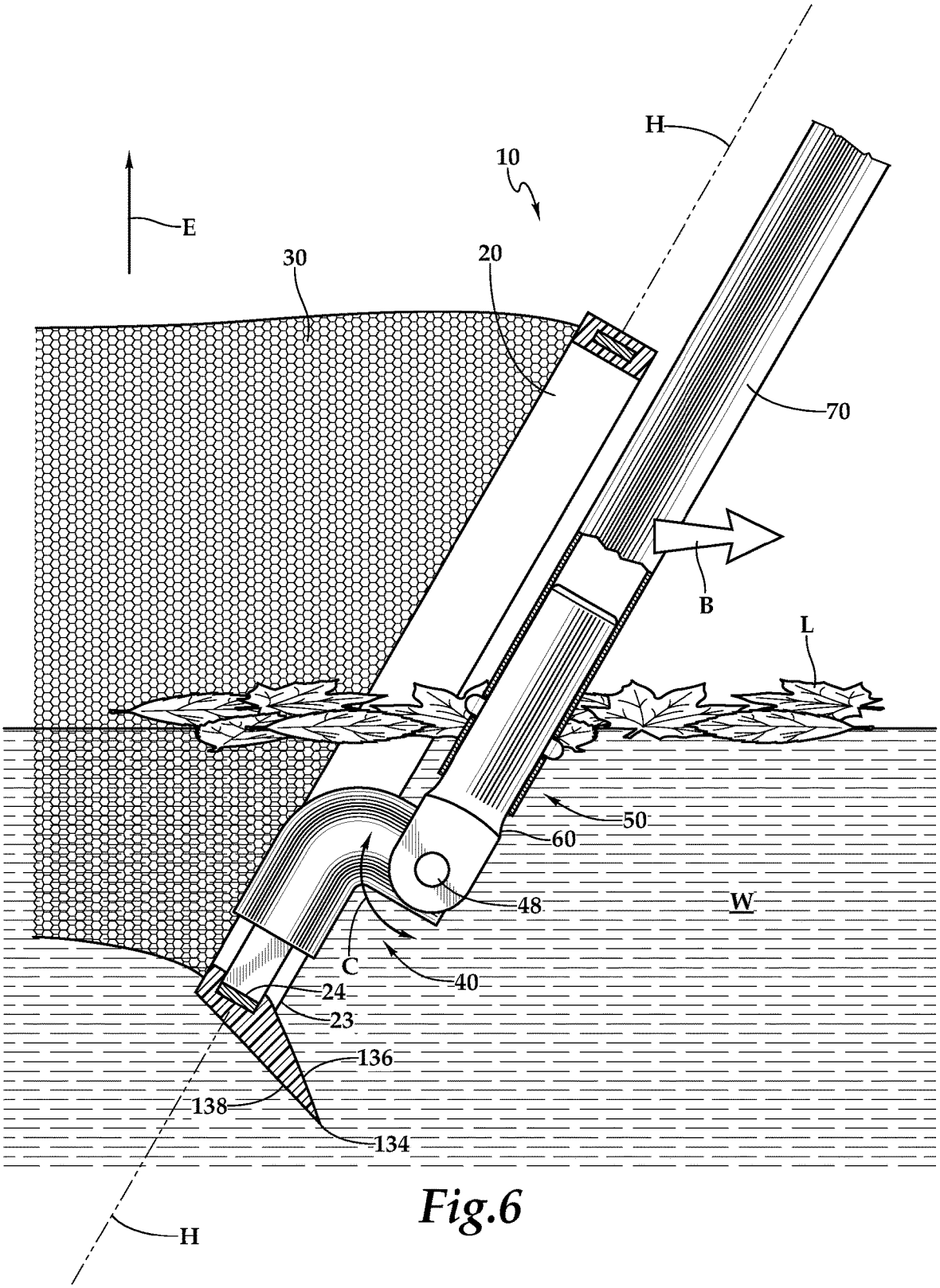
FIG. 6 is a side elevation view of the leaf rake shown in the embodiment of FIG. 1 and with the hoop and basket located within a body of water and collecting leaves while attached to a pole and moving in a rearward direction toward the user.

In essence, and with particular reference to FIGS. 1, 5 and 6, basic details of the leaf rake 10 are described according to this illustrated embodiment. A hoop 20 surrounds an opening leading into a basket 30. The basket 30 is porous, allowing water to pass through, but not leaves L or other debris, so they are captured. An elbow 40 defines one form of interface coupled to the hoop 20. The elbow 40 extends away from the hoop 20 and forward of a hoop plane H (FIGS. 5 and 6) to a leading portion of the elbow 40 or other interface that is pivotally attached to the attachment arm 50 or other attachment. The attachment arm 50 has a yoke 60 which straddles the leading portion of the elbow 40. A pivot pin 48 passes through portions of the elbow 40 or other interface and attachment arm 50 or other attachment, to facilitate pivoting between the elbow 40 and attachment arm 50. A pole 70 defines one form of elongate handle or other structure removably attachable to the attachment arm 50 and to allow for operation of the leaf rake 10 at various locations away from the user.

More specifically, and with particular reference to FIGS. 1-4, specific structural details of this illustrated embodiment of the leaf rake 10 are described. The hoop 20 is a substantially rigid structure which defines an entry into the basket 30. The hoop 20 and basket 30 can have a structure generally similar to that of known prior art manually operated leaf skimmer type tools. The basket 30 could be a deep basket such as that illustrated in FIGS. 1, 5 and 6, or could be a shallower basket. While the basket 30 is preferably formed of flexible porous fabric, the basket 30 could be more rigid in form, but still porous, to allow water W to pass therethrough but to prevent leaves L and other debris from passing therethrough.

The hoop 20 defines a continuous circuit surrounding the leading edge opening into the basket 30. In this embodiment, the hoop 20 has a contoured cover 22 overlying a spine 24. The spine 24 provides rigidity to the hoop 20. The contoured cover 22 provides a surface which is optimized for gently scraping pool surfaces, such as to collect leaves and other debris adhering to an underwater surface of the pool or other body of water.

The spine 24, while generally forming a continuous loop, typically has tabs 26 which come together to complete the circuit defined by the spine 24 of the hoop 20. These tabs 26 in prior art leaf collection baskets typically extend radially away from the center of the opening surrounded by the hoop 20. In this embodiment, the tabs 26 instead extender radially inward toward a center of the opening surrounded by the hoop 20. These tabs 26 typically only extend a short distance parallel and adjacent each other where they close their circuit, and have some form of fastener holding these tabs 26 together to keep the spine 24 of the hoop 20 in a rigid complete circuit form. The tabs 26 define a portion of the hoop 20 which is attached to the elbow 40 or other interface, as described in detail below.

The hoop 20 could have a variety of different shapes, including circular or more oval. In the illustrated embodiment, the hoop 20 has somewhat of an oval form generally including an attached long side 23 where the tabs 26 are located, and with a free long side 25 generally parallel with and opposite the attached long side 23. A pair of short curving ends 27 join the attached long side 23 to the free long side 25 at ends thereof, and complete the circuit formed by the hoop 20 in this illustrated embodiment. Other shapes could alternatively be provided for the hoop 20.

The hoop 20 generally lies within a single plane, defined as a hoop plane H (FIGS. 5 and 6). The hoop 20 could have a contour which extends slightly to either side of such a hoop plane H, and still be considered to generally be planar in form oriented within this hoop plane H. The hoop plane H generally has a forward side and a basket side, with the forward side generally defining a space on a side of the hoop plane H opposite the basket, and with the basket side generally defining a space on the side of the hoop plane which contains the basket. As explained in detail below, benefits are provided with this invention when a leading portion of the elbow 40 or other interface is located on the forward side of the hoop plane.

The basket 30 generally includes porous fabric terminating at a collar 32 at a leading edge thereof, adjacent to the hoop 20. A trailing part 34 of the basket 30 is closed and defines a portion of the basket 30 most distant from the collar 32. In one embodiment, the basket 30 is somewhat deep between a collar 32 and trailing part 34, such as with a depth between the collar 32 and trailing part 34 greater than a width of the hoop 20 between the attached long side 23 in the free long side 25.

With continuing reference to FIGS. 1-4, particular details of the elbow 40 are described, defining one form of interface in the illustrated embodiment, for joining the hoop 20 to the attachment arm 50 or other attachment. The elbow 40 includes a leading end 42 opposite a trailing end 44. A bend 46 is provided between the leading end 42 and the trailing end 44, with the leading end 42 defining one form of leading portion for the interface and the trailing end 44 defining one form of trailing portion for the interface. The bend 46 is a 90° bend in the illustrated embodiment. However, other angles of the bend 46 could be provided, such as about a 30°, 45° or 60° bend.

A pivot pin 48 or other portion of a pivot joint is coupled to the leading end 42 or other leading portion of the elbow 40 or other interface. This pivot pin 48 extends laterally and generally parallel with the hoop plane H (FIGS. 5 and 6). The pivot pin 48 typically passes through pivot holes 45 formed in opposing walls of the elbow 40 at the leading end 40 thereof. The trailing end 44 or other trailing portion of the elbow 40 or other interface is coupled to the hoop 20. Most preferably, this attachment of the elbow 40 to the hoop 20 is provided by passing of the tabs 26 into a hollow interior at the trailing end 44 of the elbow 40. A fastener, such as a bolt, screw, adhesive, clips, or other fastener preferably secures the tabs 26 or other portions of the hoop 20 rigidly to the trailing end 44 of the elbow 40. In this way, the elbow 40 or other interface remains rigidly attached to the hoop 20, and pivoting is limited to between the leading end 42 or other portion of the elbow 40 relative to the attachment arm 50. As an option, pivoting could be provided at both ends of the elbow 40, or only at the trailing end 44, and/or the bend 46 could be configured as a pivot joint.

The leading end 42 of the elbow 40 is preferably located on the forward side of the hoop plane H opposite the basket side of the hoop plane H. With such a positioning of the leading end 42 of the elbow 40, the hoop 20 and basket 30 will naturally trail behind the leading end 42 of the elbow 40 and the attachment arm 50 coupled thereto, whether the attachment arm 50 coupled to the leading end 42 of the elbow 40 is moving in a forward direction (along arrow A of FIG. 5) or in a rearward direction (along arrow B of FIG. 6).

With continuing reference to FIGS. 1-4, particular details of the attachment arm 50 are described, illustrating one embodiment of an attachment of this invention within the illustrated embodiment of the leaf rake 10, and for joining the elbow 40 or other interface pivotally to a tip 72 of a pole 70 or other elongate handle (FIGS. 5 and 6). The attachment arm 50 is an elongate structure with a distal end 52 opposite a proximal end 62. The distal end 52 includes ears 54 spaced apart by a gap 56. Holes 55 in the ears 54 are sized to receive the pivot pin 48 passing therethrough, and with the pivot pin 48 spanning the gap 56. The gap 56 is sized large enough to receive the leading end 42 of the elbow 40 therein.

A yoke 60 supports the ears 54 and joins them to a shaft 64 extending to the proximal end 62 of the attachment arm 50. This yoke 60 thus splits the shaft 54 into the two ears 54, which allows the distal end 52 of the attachment arm 50 to straddle the leading end 42 of the elbow 40 and to allow for pivotal attachment (through the pivot pin 48 of the leading end 42 of the elbow 40) to the distal end 52 of the attachment arm 50. While this pivoting arrangement between the attachment arm 50 and the elbow 40 is illustrated, other forms of pivot joints could conceivably be provided between other forms of interfaces and attachments, and to facilitate pivotal attachment between the hoop 20 and basket 30 on one side and the tip 72 of the pole 70 (FIGS. 5 and 6) on the other side. For instance, such a pivot joint could be in the form of a hinge, a flexible element, or other forms of pivoting joints.

The shaft 64 of the attachment arm 50 preferably includes spring pins 66 extending from lateral sides of the shaft 64. The spring pins 66 are sized to fit within coupling holes 76 in walls of the pole 70 adjacent to the tip 72 thereof. The tip 72 of the pole 70 preferably has a hollow bore 74 sized to receive the shaft 64 therein. The spring pins 66 are positioned along with the coupling holes 76 so that the spring pins 66 can pass into the coupling holes 76 for attachment of the attachment end 50 to the pole 70. The spring pins 66 are preferably biased toward an extended position, but can be flexed inwardly sufficient to move them out of the coupling holes 76 and for removal of the tip 72 of the pole 70 from the attachment arm 50. While the pole 70 is typically provided to allow for maneuvering of the hoop 20 and basket 30 of the leaf rake 10 a significant distance away from a user, such as reaching across a swimming pool, as an alternative some other form of elongate, but significantly shorter, handle could be utilized, such as for utilization of a leaf rake 10 in closer proximity to the user.

With particular reference to FIGS. 5 and 6, details of the use an operation of this invention are described. Initially, the leaf rake 10 is typically provided without the pole 70, as many pool owners already have a pole 70. As an alternative, the pole 70 could be provided along with the leaf rake 10. The pole 70 could be permanently attached to the leaf rake 10, but typically is removably attachable, to allow for separate storage, cleaning, handling, and replacement as needed. The leaf rake 10, including the hoop 20 and basket 30, are attached to the pole 70 at the tip 72 thereof, by placement of the shaft 64 of the attachment arm 50 into the bore 74 at the tip 72 of the pole 70, until the spring pin 66 snaps into the coupling holes 76 of the pole 70.

A user then lowers the hoop 20 and basket 30 down into water W to be cleaned of leaves L or other debris. Typically this occurs by allowing the basket 30 to dangle below the hoop 20 and with the pole 70 located above the hoop 20. The basket 30 and hoop 20 can be lowered vertically down to the water W (in a direction opposite arrow E of FIGS. 5 and 6). Once the basket 30 is contacting the water W, the leaf rake 10 is ready to be used in either a forward scooping action direction A (FIG. 5) or in a rearward scooping action direction B (FIG. 6). Typically, it is convenient to begin with the leaf rake 10 close to the user, and then be used in a forward scooping action direction A (FIG. 5). The tip 72 of the pole 70 is maneuvered directly away from the user U and generally along a surface of the water W, but optionally at any elevation relative to a surface of the water W. As the tip 72 of the pole 70 is moved in the forward scooping action direction A (FIG. 5) drag associated with water W passing through the opening in the hoop 20, and through fenestrations in the porous basket 30, cause drag of the basket 30 to result in the basket 30 trailing behind the hoop 20 as the tip 72 of the pole 70 moves generally horizontally away from the user. Such action is depicted in FIG. 5.

In such a forward scooping action (FIG. 5) it is noted that the tip 72 of the pole 70 or portions of the attachment arm 50 near the proximal end 62 thereof (FIGS. 1, 2 and 3), will abut the hoop 20, especially as the tip 72 of the pole 70 is extended a significant distance away from the user U. However, the hoop 20 will still remain mostly with the opening therein facing oncoming debris. When the leaf rake 10 has reached maximum distance away from a user, such as limited by a length of the pole 70, or a width of the pool or other body of water W being cleaned, the user is ready to reverse the leaf rake 10 into operation in the rearward scooping action direction B (FIG. 6).

A user merely transitions from pushing the pole 70 away from the user, into pulling the pole 70 toward to the user. This will cause a rotating action (along arrow C of FIGS. 5 and 6) at the joint between the elbow 40 or other interface and the attachment arm 50 or other attachment. The hoop plane H will transition to horizontal and then continue transitioning as the tip 72 (FIG. 5) of the pole 70 is drawn toward the user. This rotation (along arrow C of FIGS. 5 and 6) continues as the pole 70 is pulled in the rearward scooping action direction (arrow B of FIG. 6) in toward the user. Drag on the basket 30 will keep the basket 30 trailing behind the hoop 20 and with the hoop 20 behind the pole 70.

While FIG. 6 shows the hoop 20 and basket 30 having rotated a full 180° relative to its position during forward scooping action (FIG. 5), such rotation along arrow C could be limited to leaving the hoop 20 with the hoop plane H oriented vertically, or with the hoop 20 not rotating quite far enough along arrow C to bring the hoop plane H into a fully vertical orientation, but with an upper portion of the hoop 20 trailing somewhat behind a lower portion of the hoop 20. In any event, an opening of the hoop 20 is still facing forward for collection of leaves L and other debris as the pole 70 is drawn toward the user (along arrow B of FIG. 6).

It will be appreciated that the user never needed to rotate the pole 70 or move the pole 70 laterally to transition the hoop 20 and basket 30 from collecting leaves while moving forward to collecting leaves while moving rearward (FIG. 6). Thus, simplicity of action is provided. If a user is part way through a forward scooping action or a rearward scooping action, and is interested in transitioning, or stopping and then restarting, a user can merely lift the tip 72 of the pole 70 slightly (along arrow E of FIGS. 5 and 6) and the weight of the basket 30 will cause the basket 30 to dangle below the hoop 20 and with the hoop 20 suspended below the tip 72 of the pole 70. The user can then choose to either move forward (along arrow A) or rearward (along arrow B) and lower the tip 72 slightly to commence leaf L and other debris collection in either a forwardly or a rearwardly direction. Often when scooping leaves L floating on a surface, some leaves L will be missed and then rapidly move into a slipstream behind the moving hoop 20 and basket 30. Such a slight elevating (along arrow E) and then reversing direction (from forward along arrow A to rearward along arrow B, or from rearward to forward) will cause such leaves L falling into such a slipstream to be easily collected.

The hoop 20, and especially the contoured cover 22 of the hoop 20 (FIG. 1) preferably has a specific geometry which facilitates a lower edge of the hoop 20 scraping most effectively along an underwater surface of a pool or other body of water W. This lower edge of the hoop 20 is defined by the free long side 25 (FIG. 1) when the leaf rake 10 is moving in a forward direction (along arrow A of FIG. 5) and this lower edge is defined by the attached long side 23 (FIG. 1) when the leaf rake 10 is moving in a rearward direction (along arrow B of FIG. 6). Typically, the hoop 20 is surrounded by the contoured cover 22 (FIG. 1) which contoured cover 22 has different cross-sections depending on where the contoured cover 22 is being examined in detail. FIGS. 5 and 6 show one cross-section for a portion of a lower edge of this contoured cover 22, which is either a portion of the free long side 25 or the attached long side 23, depending on the direction in which the hoop 20 of the leaf rake 10 is being moved through the water.

In FIG. 5 a cross-section 122 of the free long side 25 is shown. This cross-section 122 most preferably represents a mid-portion of the free long side 25, but could be some other portion of the free long side 25. The central cross-section 122 includes a tip 124 defining a portion of the cross-section 122 most distant from the spine 24 and most distant from the attached long side 23 (FIG. 1) of the hoop 20. This tip 124 has a face 126 above the tip 124 and a rear 128 on a side of the tip 124 opposite the face 126. In this embodiment, the cross-section 122 has an angle at the tip 124 of approximately 30°. The rear 128 is angled so that the tip 124 typically defines a lowermost portion of the hoop 20 when in use. This tip 124 can drag along a surface of a pool at an underwater location, such as a floor of the pool. The tip 124 can thus engage and dislodge debris from a lower surface of the pool and collect it into the basket 30.

In FIG. 6 a cross-section 132 of the attached long side 23 as shown. This cross-section 132 most preferably represents a cross-section of the free long side 25 near and on either side of where the elbow 40 or other interface joins the hoop 20 to the attachment arm 50. While FIG. 1 shows a gap in the contoured cover 22 adjacent to the elbow 40 (FIG. 1), this gap could be filled with the contoured cover 22 completely filling or largely filling this area so that no gap or a smaller gap than that illustrated would be provided along this attached long side 23 of the contoured cover 22 of the hoop 20 (FIG. 1).

At this cross-section 132 of the attached long side 23, a tip 134 defines a portion of the cross-section 132 most distant from the spine 24 and most distant from the free long side 25 (FIG. 1). A face 136 is provided above the tip 134. A rear 138 is provided on a side of the tip 134 opposite the face 136. An angle of the tip 134 between the face 136 and the rear 138 can be approximately 30°. With this contour for the cross-section 132, when the leaf rake 10 is being drawn in a rearward direction toward a user (such as along arrow B of FIG. 6) the tip 134 can drag along a surface at an underwater location, such as a floor of a pool, and disturb and collect debris and pull the debris into the basket 30. The hoop 20, when the leaf rake 10 is moving in a rearward direction (along arrow B of FIG. 6) can have a hoop plane H with a variety of different angles other than the exact angle depicted in FIG. 6. The tip 134 will generally remain in contact with an underlying surface over a large range of angles for the hoop plane H, so that tip 134 contact with a floor of the pool, or other underwater surface, can largely be maintained for debris collection.

In FIGS. 5 and 6 the particular contours of the cross-sections 122, 132 are only depicted at lower edges of the hoop 20. These unique contours would be also reflected to some extent at upper edges of the hoop 20, depending on where along the upper edge defined by the attached long side 23 (FIG. 5) or the free long side 25 (FIG. 6) that the cross-section of the hoop 20 is being viewed. For simplicity, these particular cross-sections 122, 132 are only depicted at the lower edge of the hoop 20 in FIGS. 5 and 6.

Considering these cross-sections 122, 132 together, the tips 124, 134 define a widest portion of the hoop 20 between the attached long side 23 and the free long side 25 (FIG. 1), so that the tips 124, 134 can drag along a surface, such as the floor of the pool, either when moving forward (arrow A of FIG. 5) or when moving rearward (arrow B of FIG. 6). In one embodiment, the free long side 25 is not entirely rigid. When the free long side 25 comes into contact with the floor of the pool or other surface, it will deflect somewhat. To maintain the tip 124 in contact with such a surface over more than just one point, and factoring in such deflection, a central portion of the free long side 25 exhibits the cross-section 122 depicted at the lower edge of FIG. 5, but the tip 124 for other cross-sections lateral to a central portion of the free long side 25 will extend somewhat less than at a center of the free long side 25, generally as depicted in FIG. 1. In this way, when the free long side 25 comes into contact with such a surface, it will deflect slightly and the tip 124 will drag along the adjacent underwater surface over a larger contact line, to maximize debris collection.

While this invention is primarily disclosed for use by a user handling the pole 70, at an end of the pole 70 opposite the tip 72, the leaf rake 10 could be used with automated equipment, such as robotic equipment (either outside of the pool or working from a position within the pool), which could conveniently move the leaf rake 10 in a forward scooping direction (arrow A), followed by movement in a rearward scooping direction (arrow B). In one embodiment, the hoop 20 might be made sufficiently wide, that the leaf rake 10 could merely be passed along a surface of the water W, first in a forward direction, and then a rearward direction, and then back in a forward direction, cyclically. This action will tend to cause floating debris to fall into the slipstream behind the hoop 20 and basket 30 so that minimal or no lateral movement of the leaf rake 10 will be required, and facilitate automated cleaning. Such a tool and automated apparatus could additionally move the leaf rake 10 forwardly and rearwardly at elevations below the surface of the water W, for collection of neutral buoyancy suspended debris and for working of a floor of a swimming pool or other body of water W.

Most preferably, the hoop 20, basket 30, elbow 40 and attachment arm 50 together have a weight which causes them to be slightly negatively buoyant, by having a buoyant force less than their weight. This can occur by constructing the elbow 40 to not entrap air. Similarly, the attachment arm 50 can be configured to avoid air entrapment, or merely be formed of materials which are heavier than water. Also similarly, the contoured cover 22 of the hoop 20 and the basket 30 can be formed of materials, so that they are also generally neutrally point, but preferably have slightly negative buoyancy (e.g. weight force less than 10% greater than buoyant force). Such slight negative buoyancy assists in maneuvering the leaf rake 10 under the surface. Furthermore, being close to neutral (within 10% of neutral buoyancy) or slightly negatively buoyant, the leaf rake 10 can be readily maneuvered to different elevations within the pool or other body of water W, but be very easily handled at the surface of the water W as well.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A pool debris removal tool, comprising in combination:
a basket of porous material having a leading edge coupled to a hoop;
said hoop having a rigid form;
an interface fixed to the hoop;
an attachment arm pivoted to said interface and attachable to a pole;
wherein said hoop is oval in form including a pair of long segments opposite each other, and with said interface fixed to said hoop at a midpoint of one of said long segments; and
wherein said interface extends away from one of said long segments and toward the other of said long segments before bending at a portion of said interface in a direction away from said basket.

2. The tool of claim 1 wherein said attachment arm includes a distal end opposite a proximal end, said distal end pivotally attached to said interface to facilitate pivoting of the attachment arm relative to said interface about a pivoting axis parallel with a plane in which said hoop is oriented.

3. The tool of claim 2 wherein said interface has a bend of 90°.

4. The tool of claim 2 wherein said interface has a bend of 45°.

5. The tool of claim 1 wherein said tool is neutrally or slightly negatively buoyant.

6. A pool debris removal tool, comprising in combination:
a basket of porous material having a leading edge coupled to a hoop;
said hoop having a rigid form;
an interface fixed to the hoop;
an attachment arm pivoted to said interface and attachable to a pole; and
wherein said tool has a buoyant force less than ten percent less than a weight force of said tool, such that said tool has a slight negative buoyancy.

7. A debris removal apparatus for a body of water, the apparatus comprising in combination:
a basket of porous material having a leading edge coupled to a hoop;
said hoop having a rigid form surrounding an opening into said basket;
an interface coupled to said hoop;
said interface having a leading portion opposite a trailing portion;
said trailing portion of said interface coupled to said hoop;
said leading portion of said interface located on a forward side of a hoop plane in which said hoop is oriented, said forward side of said hoop located on a side of said hoop plane opposite said basket;
an attachment pivotally attached to said leading portion of said interface;
wherein said hoop has long sides spaced from each other on opposite sides of said opening, said interface attached to a midpoint of one of said long sides of said hoop; and
wherein said interface includes an elbow.

8. The apparatus of claim 7 wherein said interface is rigidly attached to said hoop.

9. The apparatus of claim 7 wherein said elbow has a bend of at least about 30° between said leading portion and said trailing portion.

10. The apparatus of claim 7 wherein an elongate pole is removably coupled to said attachment.

11. The apparatus of claim 7 wherein a pivot pin is located between said leading portion of said interface and said attachment, said pivot pin facilitating pivoting between said interface and said attachment.

12. The apparatus of claim 11 wherein said attachment includes an attachment arm having a distal end opposite a proximal end, said attachment arm including a yoke with ears at said distal end straddling a gap, said gap larger than said leading portion of said interface, said pivot pin spanning said gap between said ears with said leading portion of said interface located within said gap and with said pivot pin coupling said leading portion of said interface through said ears of said yoke to said distal end of said attachment.

13. The apparatus of claim 12 wherein said attachment arm includes a shaft at a proximal end of said attachment arm opposite said distal end, said shaft sized to fit into a bore within a tip of an elongate pole, said shaft including spring pins positioned and sized to fit within coupling holes adjacent to said tip of said pole for removable attachment of said shaft to said pole.

14. The apparatus of claim 7 wherein said hoop, said basket, said interface and said attachment arm together have negative buoyancy.

15. The apparatus of claim 7 wherein said hoop includes long sides spaced from each other on opposite sides of said opening, each of said long sides having a cross-section tapering to tips, said tips of said long sides located further from each other than a spacing between other portions of said long sides from each other.

16. The apparatus of claim 7 wherein said basket is formed of flexible porous material.

* * * * *